US007043769B2

(12) United States Patent
Chung

(10) Patent No.: US 7,043,769 B2
(45) Date of Patent: May 16, 2006

(54) WRIST PROTECTIVE SUPPORTER FOR BOWLING

(75) Inventor: Eui-Bae Chung, Seoul (KR)

(73) Assignee: Lord Field Co., Ltd., (KR)

( * ) Notice: Subject to any disclaimer, the term of this patent is extended or adjusted under 35 U.S.C. 154(b) by 0 days.

(21) Appl. No.: 11/070,055

(22) Filed: Mar. 2, 2005

(65) Prior Publication Data

US 2005/0193468 A1 Sep. 8, 2005

(30) Foreign Application Priority Data

Mar. 6, 2004 (KR) ..... 20-2004-0006053

(51) Int. Cl.
*A41D 19/00* (2006.01)

(52) U.S. Cl. ..... 2/161.1; 473/62

(58) Field of Classification Search ..... 2/162, 2/161.1; 473/62, 61
See application file for complete search history.

(56) References Cited

U.S. PATENT DOCUMENTS 4,666,158 A * 5/1987 Moro ..... 473/62
4,925,187 A * 5/1990 Fleenor et al. ..... 473/62
5,163,678 A * 11/1992 Rogers ..... 2/16
5,466,192 A * 11/1995 Castolo et al. ..... 2/161.1
6,361,447 B1 * 3/2002 Lindstrom ..... 2/161.1
6,827,653 B1 * 12/2004 Be ..... 2/161.1

* cited by examiner

*Primary Examiner*—Danny Worrell
(74) *Attorney, Agent, or Firm*—Schweitzer Cornman Gross & Bondell LLP

(57) ABSTRACT

A wrist protective supporter has a wrist section curved to cover from a wearer's arm to a wrist, a hand-back pivoting section hinge-connected to the wrist section and pivoting vertically, a hand-back supporting member engaged to the hand-back pivoting section to pivot from side to side, a rail provided to the wrist section to face the hand-back pivoting section, a slider moving along the rail and pushing and pivoting the hand-back pivoting section downward by interfering with the hand-back pivoting section, an engaging section provided to the slider and engaged or disengaged with the rail, and a knob releasably engaged to the hand-back supporting member by passing through the hand-back pivoting section. The wrist protective supporter for bowling supports a wrist to correctly throw a ball while preventing an injury which may happen due to a shock to the wrist during the bowling.

5 Claims, 7 Drawing Sheets

WRIST PROTECTIVE SUPPORTER FOR BOWLING

CROSS-REFERENCE TO RELATED APPLICATIONS

This application claims all benefits of Korean Utility Model Application No. 2004-6053, filed on Mar. 6, 2004 in the Korean Intellectual Property Office, the disclosures of which is incorporated herein by reference.

BACKGROUND OF THE INVENTION

1. Field of the Invention

The present invention relates to a wrist protective supporter for bowling supporting a wrist to correctly throw a ball while preventing an injury which may happen due to a shock to the wrist during the bowling, and more particularly to a wrist protective supporter for bowling capable of easily pivoting a hand-back section vertically and from side to side according to a wearer's throwing characteristic to regulate an angle, and easily replacing the back of the hand section (which is herein also described as "hand-back section") of the protective supporter with a hand-back section having a suitable structure according to a change of a wearer's throwing characteristic.

2. Description of the Prior Art

In general, a wrist protective supporter is a bowling utensil preventing an injury of a wrist or finger which may happen due to a weight of a bowling ball during the bowling and allowing a user to correctly throw the ball according to her or his throwing characteristic, thereby improving a performance. Various types of wrist protective supporter are developed and commercialized. Hereinafter, the protective supporter will be briefly described as follows.

A wrist protective supporter having a general and simplest structure comprises a bottom surface made of an adsorptive material so that a user can easily handle a bowling ball, and protects the wrist by fixing and preventing the wrist from being bended back.

A wrist protective supporter having a more complicated structure than that described above is structured such that a wearer can arbitrarily adjust an angle of a wrist section and a hand-back section and thus easily put spin on the bowling ball when throwing the ball. The wrist protective supporter capable of adjusting the angle is shown in FIG. 1. Referring to FIG. 1, the wrist protective supporter comprises a hand-back section 30 adhering closely to the back of the hand, a wrist section 10 adhering closely to an exterior of the wrist, an angle adjusting section 20 connecting the hand-back section 30 and the wrist section 10 and adjusting a connecting angle between the hand-back section 30 and the wrist section 10 from side to side or up and down. The angle adjusting section 20 and the wrist section 10 are connected by a screw type angle adjusting means 50 and a catching type angle adjusting means 60. The wrist section 10 is pivoted from side to side by the screw type angle adjusting means 50 and vertically pivoted by the catching type angle adjusting means 60.

The catching type angle adjusting means 60 comprises a catching piece 61 operated by a spring and having a catching protrusion (not shown) which is formed on a bottom surface of the catching piece 61 and inserted into a plurality of catching recesses 65 perforated in equal intervals on the hand-back section 30. Accordingly, the bended angle between the wrist section 10 and the hand-back section 30 is adjusted according to whether the catching protrusion formed on the bottom surface of the catching piece 61 is inserted into any one of the catching recesses 65 perforated on the hand-back section 30. However, according to this manner, when the hand-back section 30 is bended back, the catching piece 61 is easily deviated from the catching recesses 65. When the catching piece 61 is deviated from the catching recesses 65, a wrist may be injured. In other words, when a wearer swings a bowling ball while stepping, the wearer's wrist may be bended back due to a weight of the bowling ball and thus be injured. In addition, when handling the catching type angle adjusting means 60, since the wearer should remove the catching piece 61 from the catching recess 65 and then insert it into another catching recess 65, the handling is inconvenient and the structure is also complicated.

Meanwhile, if a beginner continuously practices the bowling, as her or his bowling ability is improved to an expert, a throwing characteristic is also gradually changed. However, the screw type angle adjusting means 50 can adjust only the angle due to a hinge connection of the hand-back section 30 and the wrist section 10 and the hand-back section 30 and the wrist section 10 aren't separated. Accordingly, when the throwing characteristic is changed after purchasing a wrist protective supporter comprising the hand-back section 30 initially fitted to a user, the user should purchase another wrist protective supporter.

SUMMARY OF THE INVENTION

Accordingly, the present invention has been made to solve the above-mentioned problems occurring in the prior art. The object of the present invention is to provide a wrist protective supporter for bowling comprising removably attached hand-back section and wrist section and capable of easily adjusting the hand-back section vertically and from side to side and replacing the hand-back section with a hand-back section suitable for a throwing characteristic changed according as a user's throwing characteristic is changed.

In order to accomplish this object of the present invention, there is provided a wrist protective supporter for bowling, the wrist protective supporter comprising:

a wrist section curved to cover from a wearer's arm to a wrist;

a hand-back pivoting section hinge-connected to the wrist section and pivoting vertically;

a hand-back supporting member engaged to the hand-back pivoting section to pivot from side to side;

a rail provided to the wrist section to face the hand-back pivoting section;

a slider moving along the rail and pushing and pivoting the hand-back pivoting section downward by interfering with the hand-back pivoting section;

an engaging section provided to the slider and engaged or disengaged with the rail; and a knob releasably engaged to the hand-back supporting member by passing through the hand-back pivoting section.

Herein, a guide recess into which the rail is inserted is formed in the slider to move along the rail.

Meanwhile, the rail is formed in opposed inner surfaces of the slide recess formed in a longitudinal direction of the wrist section in a middle of a width of a leading end of the wrist section abutting on the hand-back pivoting section, respectively; a plurality of engaging recesses are formed in the rail in the longitudinal direction thereof; and the engaging section is inserted or withdrawn into or from the engaging recesses.

Also, the engaging section comprising:

a vertical through-hole formed in the slider;

a button inserted into the vertical through-hole and moving in a longitudinal direction of the vertical through-hole by an applied force;

an engaging piece protruded from both lower ends of the button; and a coil spring including an end abutting on a bottom surface of the button and the other end abutting on a catching step formed on a lower end of the vertical through-hole.

Herein, a bolt is formed on a center of a bottom surface of the knob, a nut is fixed on an upper surface of the hand-back supporting member and the bolt passes through the hand-back pivoting section and thus is engaged to the nut of the hand-back supporting member.

Also, a rubber washer is positioned between the hand-back pivoting section and the hand-back supporting member.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. In the following description of the present invention, a detailed description of known functions and configurations incorporated herein will be omitted when it may make the subject matter of the present invention rather unclear.

Figure 1:
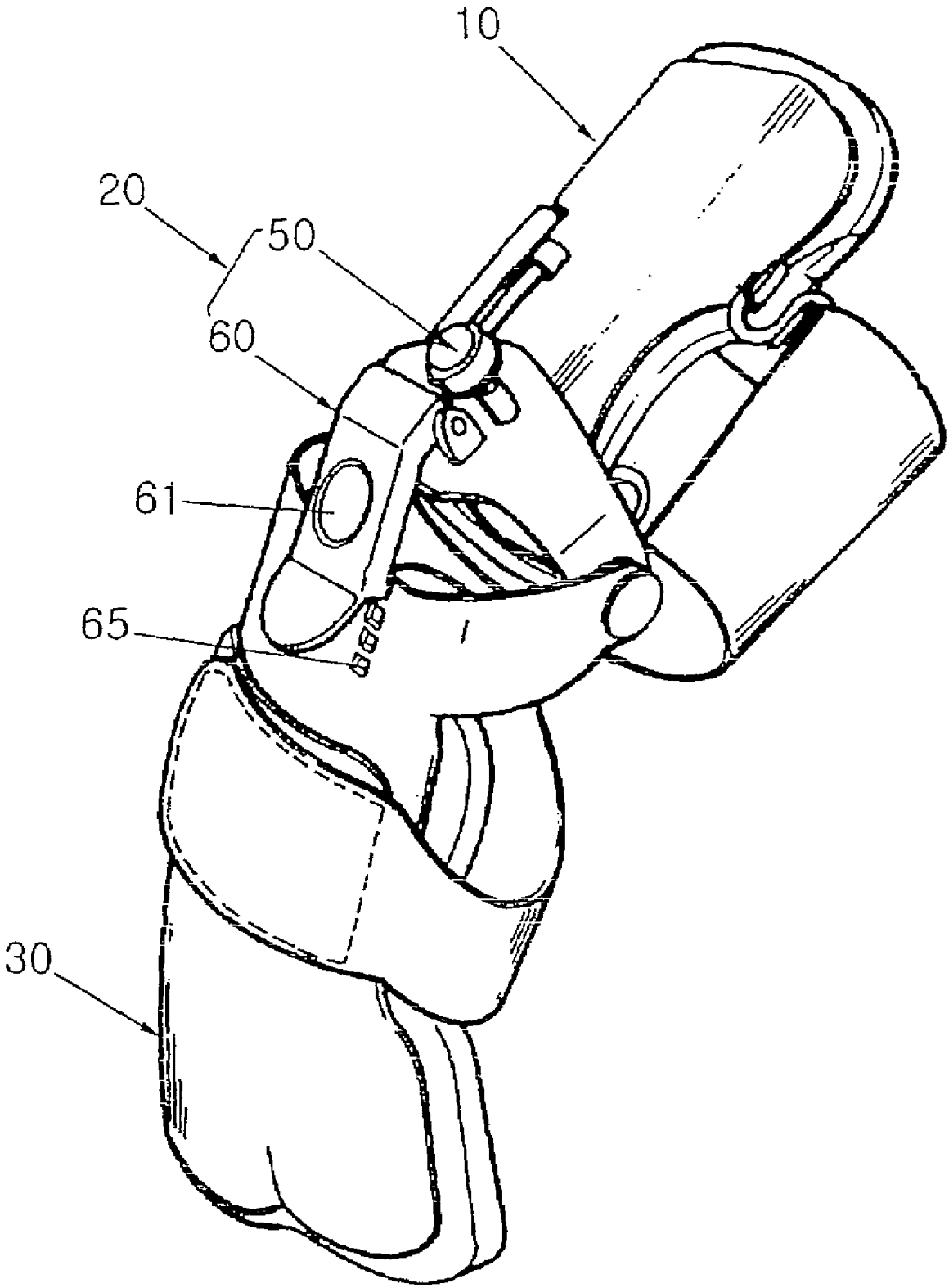
FIG. 1 (Prior Art)
FIG. 1 is a perspective view of a wrist protective supporter according to the prior art.
Figure 2:
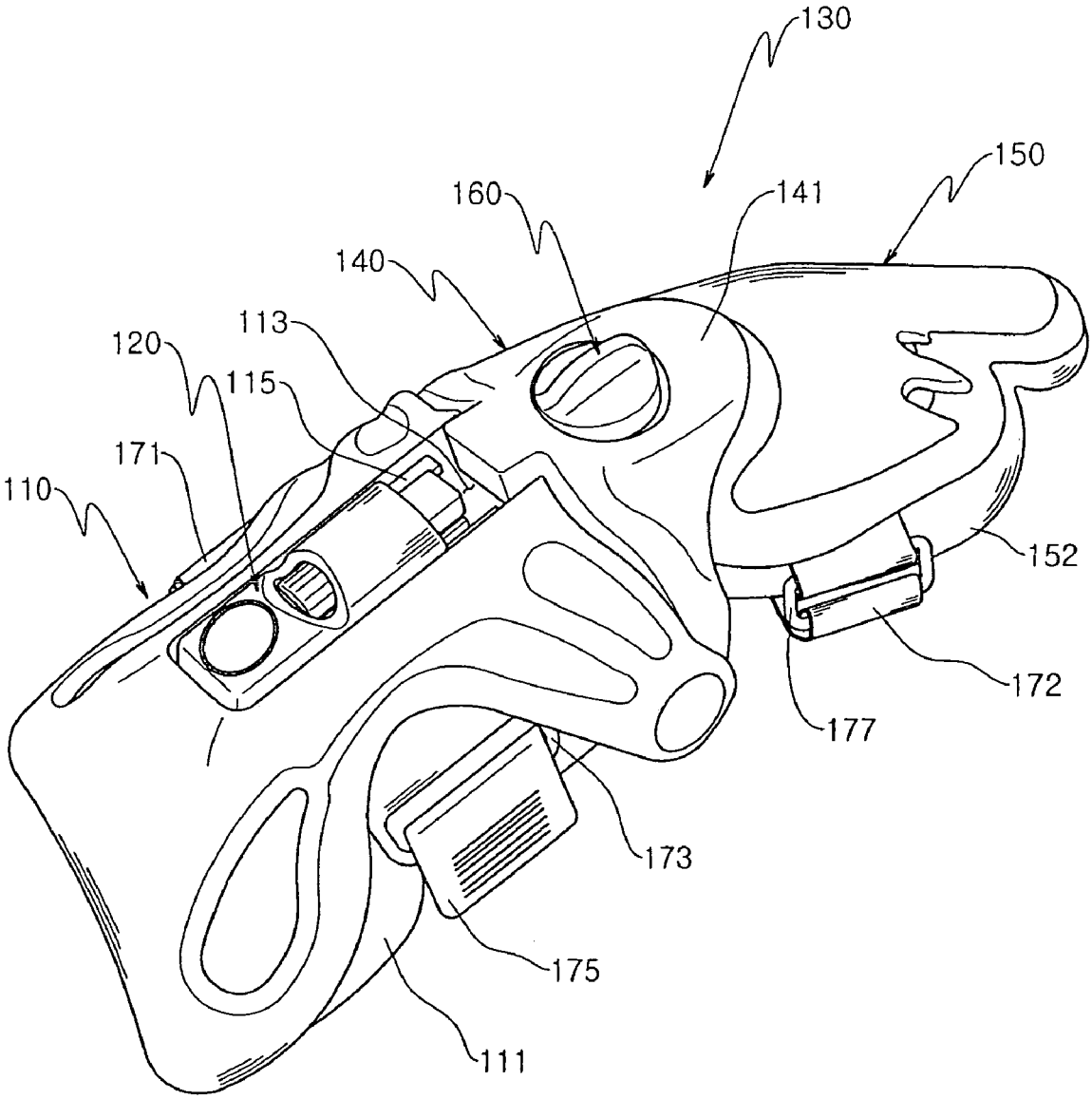
FIG. 2 is a perspective view of a wrist protective supporter according to an embodiment of the invention.

FIG. 2 is a perspective view of a wrist protective supporter according to an embodiment of the invention. As shown in FIG. 2, a wrist protective supporter according to an embodiment of the invention comprises a wrist section 110 covering an exterior from a wearer's arm to a wrist and a hand-back section 130 hinge-connected to a leading end of the wrist section 110, pivoting up and down and covering the back of the hand and fingers of the wearer. The hand-back section 130 is divided into a hand-back pivoting section 140 hinge-connected to the wrist section 110, pivoting up and down and a hand-back supporting member 150 screw-engaged with the hand-back pivoting section 140, pivoting from side to side and supporting the back of the hand and the fingers of the wearer.

Figure 3:
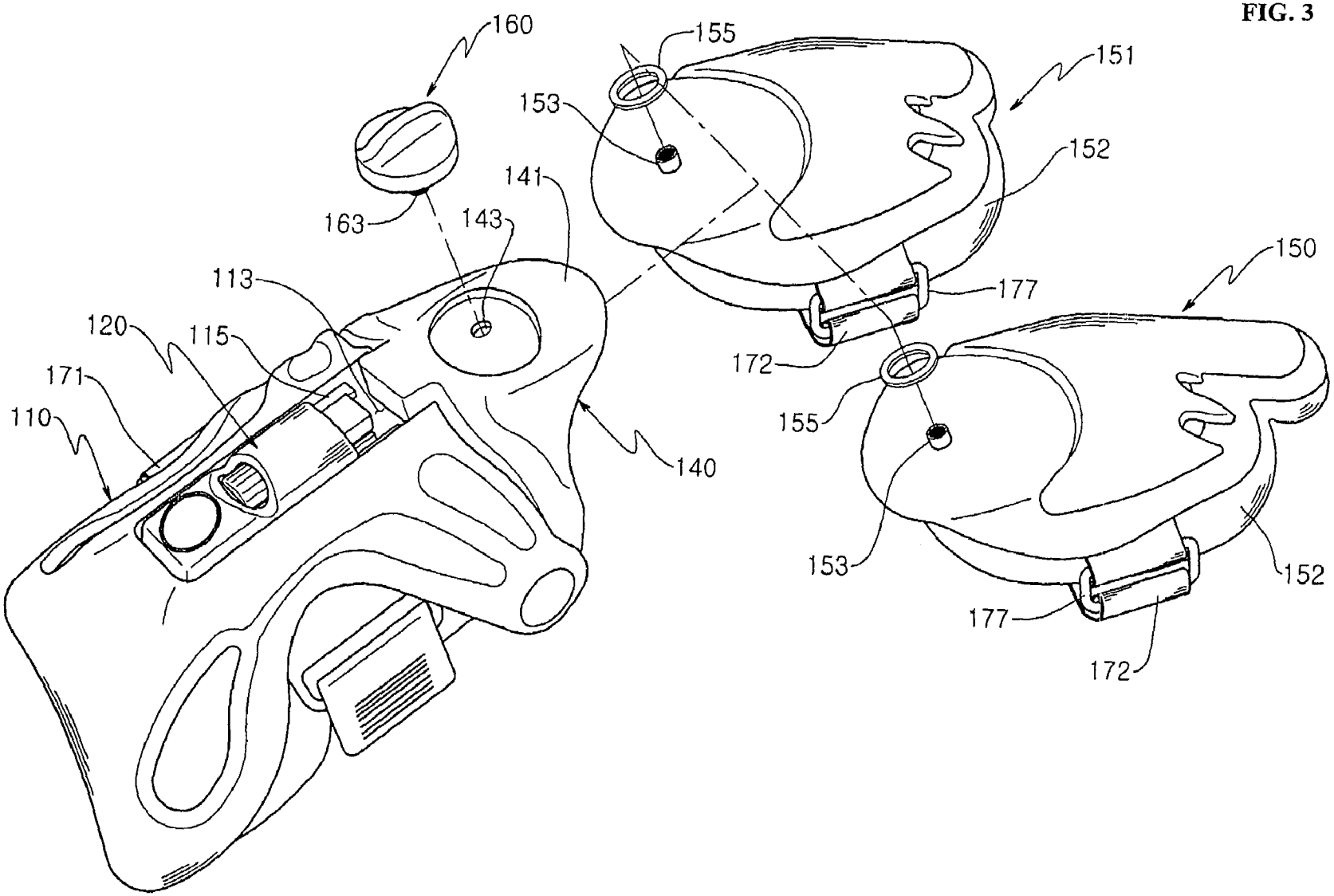
FIG. 3 is an exploded perspective view of the wrist protective supporter shown in FIG. 2.
Figure 4:
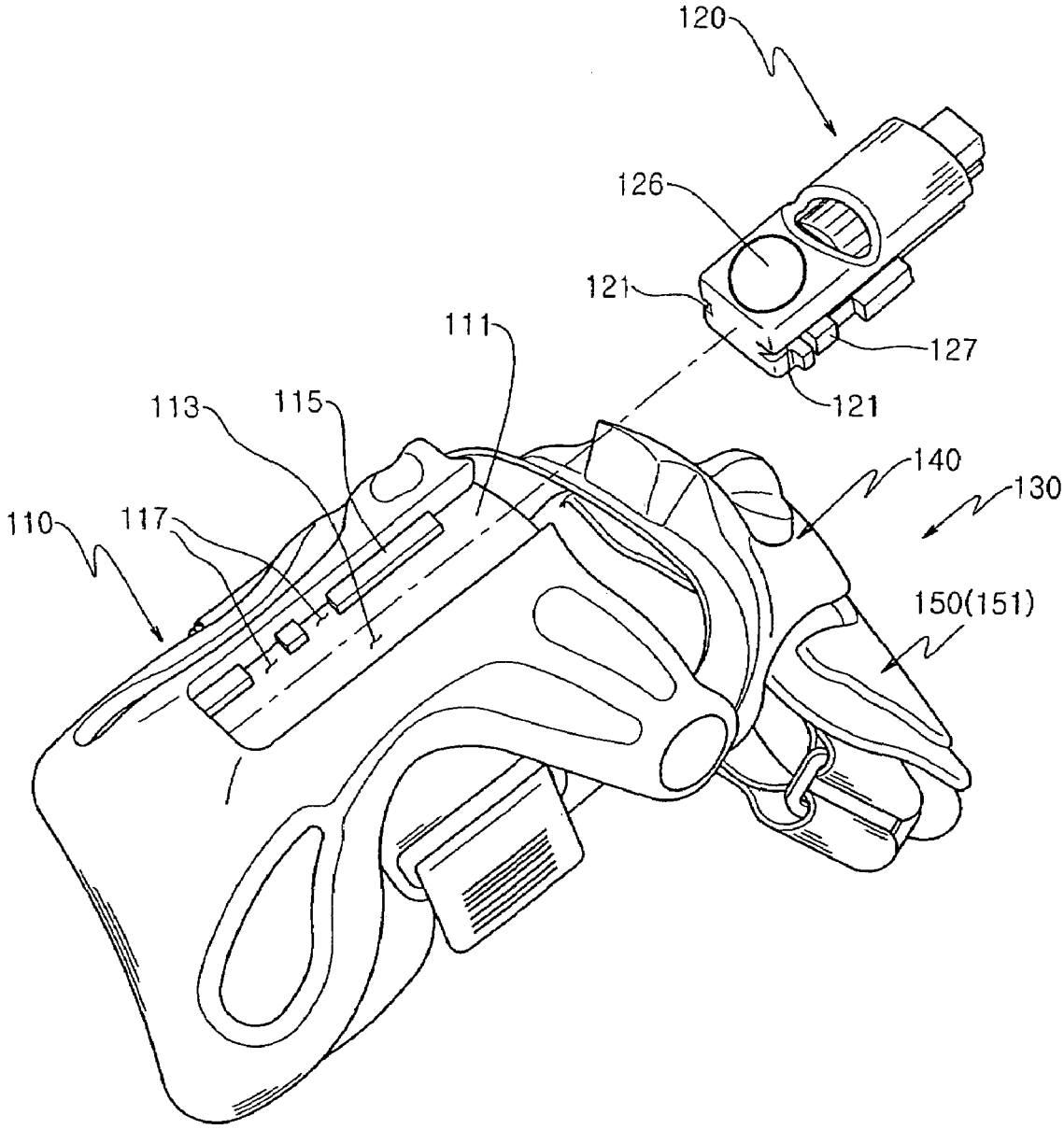
FIG. 4 is a perspective view showing a state that a slider is separated from a rail of a wrist section shown in FIG. 3.

FIG. 3 is an exploded perspective view of the wrist protective supporter shown in FIG. 2 and FIG. 4 is a perspective view showing a state that a slider is separated from a rail of a wrist section shown in FIG. 3. The wrist protective supporter for bowling according to an embodiment of the invention will be more specifically described with reference to FIGS. 3 and 4.

As shown in FIGS. 3 and 4, the wrist section 110 is curved in a width direction thereof and covers an exterior from an arm to a wrist. A Velcro tape is adhered to an inside of the curved wrist section 110 and a first cushion pad 111 is adhered to the Velcro tape to increase a feel and to allow the wrist section 110 to be adhered closely to the arm and thus to support the arm more safely when the wrist section 110 covers the arm.

A rail 115 is formed in a middle of a width of the wrist section 110 in a longitudinal direction of the wrist section 110. A slider 120 moves back and forth along the rail 110. When the slider 120 is located to be protruded forward, the hand-back pivoting section 140 of the hand-back section 130 is pushed and thus pivoted downward. To the contrary, when the slider 120 moves rearward along the rail 115 and thus does not interfere with the hand-back pivoting section 140, the hand-back pivoting section 140 can pivot upward to the maximum extent, so that it abuts on the leading end of the wrist section 110. Like this, when the hand-back pivoting section 140 pivots upward to the maximum extent, an angle with the wrist section 110 becomes 0 degree and thus the hand-back pivoting section 140 is linearly extended from the wrist section 110.

Meanwhile, the hand-back pivoting section 140 is curved in a width direction to cover the wrist, and both sides of the hand-back pivoting section 140 are hinge-connected to both sides of the leading end of the wrist section 110, respectively. Accordingly, when the hand-back pivoting section 140 pivots upward to the maximum extent, a part of a rear end of the hand-back pivoting section 140 is inserted into the wrist section 110 and thus abuts on the slider 120. Accordingly, when the slider 120 is advanced forward, the slider 120 pushes the hand-back pivoting section 140 to be pivoted downward. A protrusion 141 having a semi-circle shape is formed on the middle of the width of the hand-back pivoting section 140, and a through-hole 143 is formed in a center of the protrusion 141. Meanwhile, a rotating knob 160 is formed with a bolt 163 on the bottom surface thereof. Under state that the rotating knob 160 is located on an upper surface of the protrusion 141, the bolt 163 of the rotating knob 160 passes through the through-hole 143 of the protrusion 141 and is engaged with one of the hand-back supporting members 150, 151 located on a lower part of the hand-back pivoting section 140.

Also, as shown in FIG. 3, one of the hand-back supporting members 150, 151 covers the back of the hand, an index finger, a middle finger, a third finger and a little finger, and a nut 153 is fixed to an exterior surface of a region thereof corresponding to the back of the hand. Such hand-back supporting members 150, 151 are somewhat differently structured according to a throwing characteristic. Of the two hand-back supporting members 150, 151 shown in FIG. 3, the hand-back supporting member 150 having a part formed long correspondingly to the index finger is used to throw the heavier bowling ball rather than another hand-back supporting member 151. In general, compared to the beginner who started to learn the bowling, a weight of the bowling ball is gradually increased so as to improve a power as it is proficient to the bowling.

Figure 5:
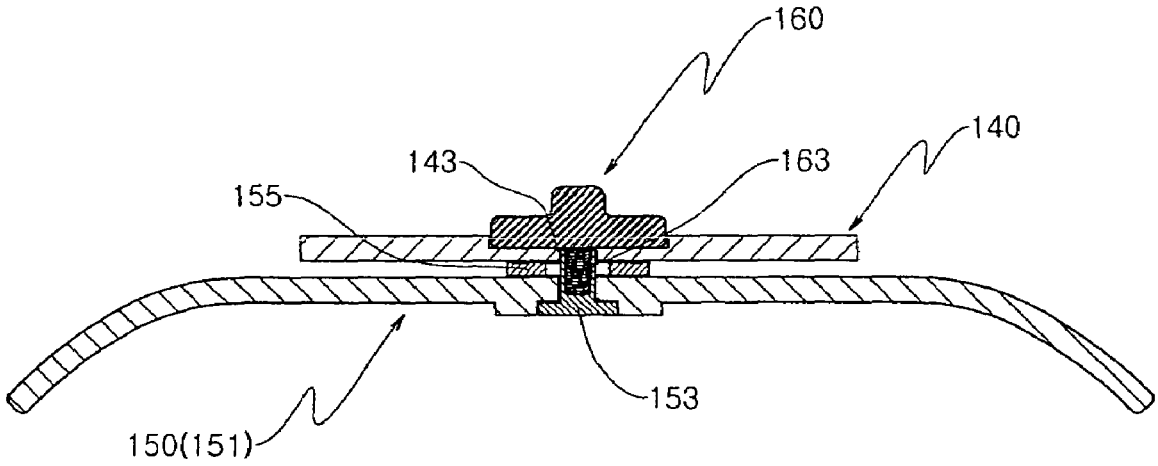
FIG. 5 is a sectional view showing an engaged state of a hand-back supporting member and a hand-back pivoting section shown in FIG. 2.

Meanwhile, FIG. 5 is a sectional view showing an engaged state of a hand-back supporting member and a hand-back pivoting section shown in FIG. 2. As shown in FIG. 5, one of the hand-back supporting members 150, 151 is located on the lower part of the through-hole 143 of the hand-back pivoting section 140, and the bolt 163 of the rotating knob 160 is engaged with the nut 153 after having passed through the through-hole 143 of the hand-back pivoting section 140. Accordingly, the bolt 163 of the rotating knob 160 is engaged or disengaged with the nut 153 according to the rotating direction of the rotating knob 160. Under the engaged state of the bolt 163 and the nut 153, when the bolt 163 is firmly tightened after adjusting the angle of one of the hand-back supporting members 150, 151, one of the hand-back supporting members 150, 151 is fixed with being angle-adjusted to the hand-back pivoting section 140. Under this state, when it is desired to replace one of the hand-back supporting members 150, 151 with another hand-back supporting member, the bolt 163 is released from the nut 153 by rotating the rotating knob 160, and thus one of the hand-back supporting members 150, 151 and the hand-back pivoting section 140 are separated. Then, it is replaced with another hand-back supporting member and engaged. In addition, a Velcro tape is adhered to an inner surface of one of the hand-back supporting members 150, 151, so that a second cushion pad (refer to FIG. 2) 152 is adhered by the Velcro tape. Further, a rubber washer 155 covering the bolt 163 is provided to between the hand-back pivoting section 140 and one of the hand-back supporting members 150, 151, thereby preventing the hand-back pivoting section 140 and one of the hand-back supporting members 150, 151 from being damaged due to a tightening force of the bolt 163.

Hereinafter, the rail 115 and the slider 120 provided to the wrist section 110 will be more specifically described.

Referring to FIG. 4 again, a slide recess 113 is formed in the middle of the width of the wrist section 110 in a direction from the leading end to the rear end, and the rails 115 are formed on both opposed inner surfaces of the slide recess 113 in a longitudinal direction of the slide recess 113. A plurality of engaging recesses 117 are provided to the rails 115 along the length thereof.

Figure 6:
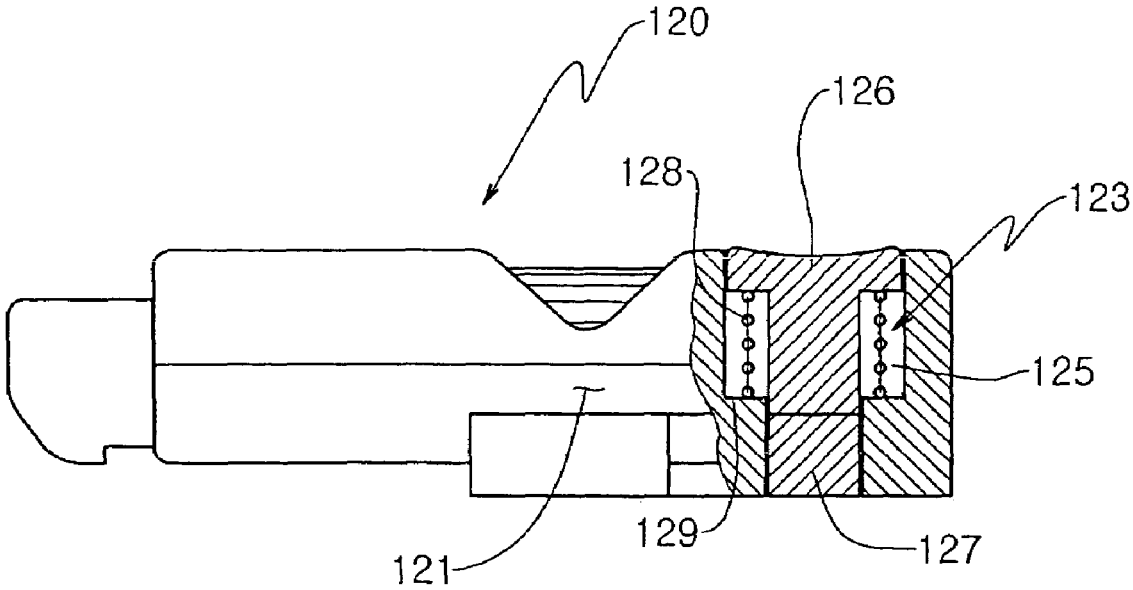
FIG. 6 is a partial sectional view of the slider shown in FIG. 4.
Figure 7:
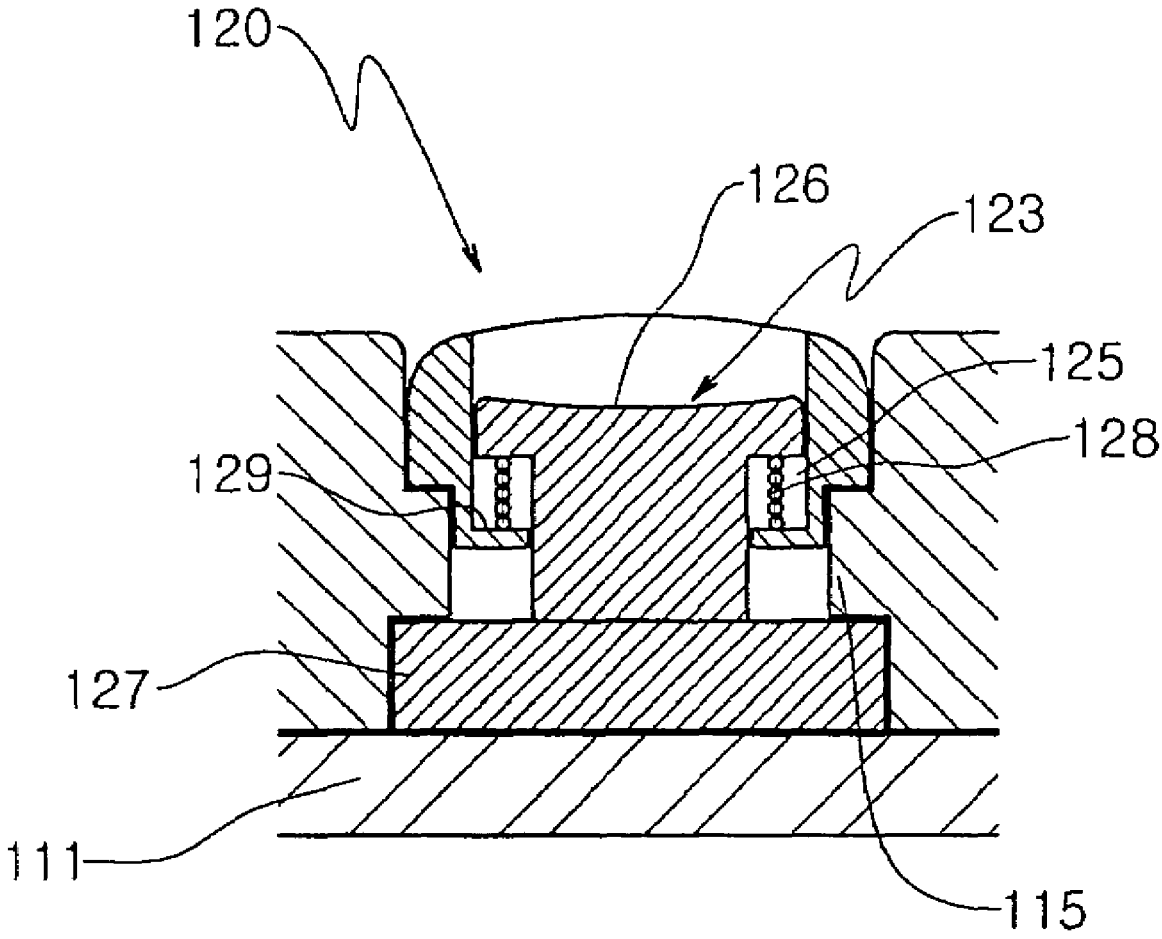
FIG. 7 is a cross-sectional view of the slider moving along the rail shown in FIG. 4.

Meanwhile, FIG. 6 is a partial sectional view of the slider shown in FIG. 4 and FIG. 7 is a cross-sectional view of the slider moving along the rail shown in FIG. 4.

Referring to FIGS. 6 and 7, the slider 120 located in the slide recess (refer to FIG. 4) 113 of the wrist section (refer to FIG. 4) 110 is provided with the guide recess 121 having a width and a depth of the thickness of the rail 115 which is formed on both sides of the slider 120 in a longitudinal direction of the slider 120, and an engaging section 123 having an elastic acting from the lower part to the upper part of the guide recess 121 is formed on a side of the guide recess 121. Accordingly, when the slider 120 is inserted into the slide recess 113 so that the rail 115 is inserted into the guide recess 121 of the slider 120, the slider 120 moves to the front and the rear of the wrist section 110 along the rail 115. When the engaging section 123 corresponds to the engaging recess 117 of the rail 115 as the slider 120 moves, the engaging section 123 moves upward, so that it is inserted into the engaging recess 117 and thus the slider 120 is fixed.

Hereinafter, the engaging section 123 of the slider 120 will be described.

As shown in FIGS. 6 and 7, a vertical through-hole 125 is formed in the rear end of the slider 120, and a button 126 is inserted into the vertical through-hole 125. An engaging piece 127 is formed to protrude to both sides on a lower end of the button 126. A tensioned coil spring 128 is located in the vertical through-hole 125 with it covering the button 126. An upper end of the tensioned coil spring 128 abuts on a bottom surface of the button 126 and a lower end of the tensioned coil spring 128 abuts on a catching step 129 formed on the lower end of the vertical through-hole 125. Accordingly, when the button 126 is pushed, the coil spring 128 is compressed and the engaging piece 127 is moved downward. When a force applied to the button 126 is removed, the coil spring 128 is elastically restored, so that the button 126 is pushed upward and the engaging piece 127 is also moved upward.

When the engaging piece 127 is inserted into the engaging recess (refer to FIG. 4) 117 of the rail (refer to FIG. 4) 115 by the operations of the button 126, the engaging piece 127 and the coil spring 128, the slider 120 is stopped. Under this state, when the button 126 is pushed, the engaging piece 127 is withdrawn from the engaging recess 117 and the slider 120 again moves along the rail 115.

Referring to FIG. 2 again, when the slider 120 moves forward along the rail 115, it pushes and pivots the hand-back pivoting section 140 downward, and when the slider 120 moves rearward, it does not interfere with the hand-back pivoting section 140, so that the hand-back pivoting section 140 pivots upward to the maximum extent.

Meanwhile, fixing bands 171, 172 are provided to the wrist section 110 and one of the hand-back supporting members 150, 151 to fix an arm and a palm located inside of the wrist section 110 and one of the hand-back supporting members 150, 151. More specifically, a ring 173 is fixed on both side ends of the curved wrist section 110, respectively, a hook 175 which is engaged with the ring 173 is fixed on one end of the fixing band 171, and the Velcro tape is adhered to the other end of the fixing band 171. Accordingly, when the hook 175 is engaged with the ring 173, the fixing band 171 is passed through the other ring, and then the Velcro tape is adhered each other, the fixing band 171 is fixed with covering around the arm located inside of the wrist section 110.

In addition, a ring 177 is formed on one end of the width of one of the hand-back supporting members 150, 151, an end of the fixing band 172 is fixed on the other end of the width of one of the hand-back supporting members 150, 151 and the Velcro tape is adhered to the fixing band 172. Accordingly, when the fixing band 172 is passed through the ring 177 and then the Velcro tape of the fixing band 172 is adhered, the fixing band 172 is fixed with covering the palm located inside of one of the hand-back supporting members 150, 151.

Hereinafter, an operation relationship of the wrist protective supporter for bowling according to the invention as described above will be explained.

A user selects one of the hand-back supporting members 150, 151 according to her or his throwing characteristic. Then, one of the hand-back supporting members 150, 151 is positioned to the lower part of the hand-back pivoting section 140, and the bolt 163 of the rotating knob 160 is passed through the through-hole 143 of the hand-back pivoting section 140 and then engaged with the nut 153 of one of the hand-back supporting members 150, 151.

During engaging the bolt 163 with the nut 153, the rotating knob 160 is rotated and firmly tightened under state that the right and left angle of one of the hand-back supporting members 150, 151 is set. Then, one of the hand-back supporting members 150, 151 and the hand-back pivoting section 140 are integrated.

Under this state, the vertical angle of the hand-back section 130 and the wrist section 110 is adjusted. At this time, the wearer moves the slider 120 along the rail 115, i.e., the length of the slide recess 113 by pushing or drawing the slider 120 with pushing down the button 126 of the slider 120. At this time, when the slider 120 is advanced by pushing it, the hand-back pivoting section 140 is pivoted downward due to the interference of the leading end of the slider 120 of the hand-back pivoting section 140, thereby increasing the bended angle of the hand-back pivoting section 140. When the slider 120 is drawn rearward, the hand-back pivoting section 140 is pivoted upward, thereby gradually decreasing the bended angle. In general, in order to put spin on a ball or achieve a hook, it is advantageous that the downward pivoting angle of the hand-back section 130, i.e., the bended angle is large and the right and left pivoting angle of one of the hand-back supporting members 150, 151 is also large. However, the vertical bended angle and the right and left pivoting angle can be changed without limit according to the wearer's throwing characteristic.

As described above, according to the wrist protective supporter for bowling of the invention, the slide recess 113 is formed on the wrist section 110, and the rails 115 are provided to the opposed inner surfaces of the slide recess 113, so that the slider 120 moves along the rails 115. However, it is should be understood that the objects and effects of the invention can be achieved even though a pair of rails are fixed on the upper surface of the wrist section without the slide recess formed in the wrist section and the slider is mounted and moved in the fixed rails.

As described above, according to the wrist protective supporter for bowling, in order to adjust the vertical bended angle of the wrist section 110 and the hand-back section 130, when the slider 120 is moved under the button 126 of the slider 120 being pushed and then located in a proper position, the engaging piece 127 is inserted into the engaging recess 117 of the rail 115 and thus the slider 120 is fixed, so that the hand-back section 130 is not pivoted upward due to the interference of the fixed slider 120 and the wrist section 110, thereby preventing the wrist from being bended back due to the bowling ball in swinging.

Further, according to the wrist protective supporter for bowling, one of the hand-back supporting members 150, 151 can be removably attached to the hand-back pivoting section 140. Accordingly, as the wearer's throwing characteristic is changed, a suitable structure of the hand-back supporting member can be provided, so that the wearer can throw the bowling ball according to her or his changed throwing characteristic.

In addition, according to the wrist protective supporter for bowling, since one of the hand-back supporting members 150, 151 and the hand-back pivoting section 140 are structured to be removably attached, it is possible to adjust the right and left pivoting angle of one of the hand-back supporting members 150, 151 using the engagement configurations of the rotating knob 160 and the nut 153, to simplify the structure of the wrist protective supporter and to extend the functions thereof.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A wrist protective supporter for bowling comprising:

a wrist section curved to cover from a wearer's arm to a wrist;

a hand-back pivoting section hinge-connected to the wrist section and pivoting vertically;

a hand-back supporting member engaged to the hand-back pivoting section to pivot from side to side; and a knob releasably engaged to the hand-back supporting member by passing through the hand back pivoting section, wherein a bolt is formed on a center of a bottom surface of the knob, a nut is fixed on an upper surface of the hand-back supporting member and the bolt passes through the hand-back pivoting section and thus is engaged to the nut of the hand-back supporting member, the hand-back supporting member being able to be replaced by releasing the bolt of the knob from the nut.

2. The wrist protective supporter for bowling according to claim 1, wherein a rubber washer is positioned between the hand-back pivoting section and the hand-back supporting member.

3. The wrist protective supporter for bowling according to claim 1, further comprising:

a rail provided to the wrist section to face the hand-back pivoting section;

a slider moving along the rail and pushing and pivoting the hand-back pivoting section downward by interfering with the hand-back pivoting section; and an engaging section provided to the slider and engaged or disengaged with the rail.

4. The wrist protective supporter for bowling according to claim 3, wherein the rail is formed in opposed inner surfaces of a slide recess formed in a longitudinal direction of the wrist section in a middle of a width of a leading end of the wrist section abutting on the hand-back pivoting section, respectively; a plurality of engaging recesses are formed in the rail in the longitudinal direction thereof; and the engaging section is inserted or withdrawn into or from the engaging recesses.

5. The wrist protective supporter for bowling according to claim 4, wherein the engaging section comprises:

a vertical through-hole formed in the slider;

a button inserted into the vertical through-hole and moving in a longitudinal direction of the vertical through-hole by an applied force;

an engaging piece protruded from both lower ends of the button; and a coil spring including an end abutting on a bottom surface of the button and the other end abutting on a catching step formed on a lower end of the vertical through-hole.

* * * * *